US007270927B2

(12) United States Patent
Wu et al.

(10) Patent No.: US 7,270,927 B2
(45) Date of Patent: Sep. 18, 2007

(54) NON-HALOGENATED POLYMERIC BINDER

(75) Inventors: Jin Wu, Webster, NY (US); Francisco Lopez, Rochester, NY (US); Lanhui Zhang, Webster, NY (US); Yuhua Tong, Webster, NY (US); Liang-bih Lin, Webster, NY (US); John S Chambers, Rochester, NY (US); Cindy Chen, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 397 days.

(21) Appl. No.: 10/986,847

(22) Filed: Nov. 15, 2004

(65) Prior Publication Data

US 2006/0105253 A1 May 18, 2006

(51) Int. Cl.
*G03G 5/00* (2006.01)

(52) U.S. Cl. ..... 430/96; 430/59.1; 399/159

(58) Field of Classification Search ..... 430/96, 430/59.1; 399/159
See application file for complete search history.

(56) References Cited

U.S. PATENT DOCUMENTS

| | | | | |
|---|---|---|---|---|
| 3,634,080 | A * | 1/1972 | Noe et al. | 430/89 |
| 4,654,284 | A | 3/1987 | Yu et al. | |
| 4,668,600 | A * | 5/1987 | Lingnau | 430/83 |
| 5,342,784 | A * | 8/1994 | Yamada et al. | 430/49 |
| 5,725,985 | A | 3/1998 | Nealey et al. | |
| 6,017,666 | A | 1/2000 | Nealey et al. | |
| 2003/0148201 | A1 * | 8/2003 | Kodera et al. | 430/74 |

OTHER PUBLICATIONS

Chemical Abstracts Registry No. 25609-89-6, Nov. 16, 1984.*

* cited by examiner

*Primary Examiner*—Mark A. Chapman
(74) *Attorney, Agent, or Firm*—Oliff & Berridge, PLC

(57) ABSTRACT

A non-halogenated binder material, such as for an electrophotographic imaging member binder, includes a copolymer of vinyl acetate and vinyl acid.

11 Claims, 2 Drawing Sheets

NON-HALOGENATED POLYMERIC BINDER

BACKGROUND OF THE INVENTION

1. Field of Invention

The present invention relates to non-halogenated polymeric binders used, for example, in electrophotographic imaging members.

2. Description of Related Art

In xerography, or electrophotographic printing/copying, an electrophotographic imaging member is electrostatically charged. For optimal image production, the electrophotographic imaging member should be uniformly charged across its entire surface. The electrophotographic imaging member is then exposed to a light pattern of an input image to selectively discharge the surface of the electrophotographic imaging member in accordance with the image. The resulting pattern of charged and discharged areas on the electrophotographic imaging member forms an electrostatic charge pattern (i.e., a latent image) conforming to the input image. The latent image is developed by contacting it with finely divided electrostatically attractable powder called toner. Toner is held on the image areas by electrostatic force. The toner image may then be transferred to a substrate or support member, and the image is then affixed to the substrate or support member by a fusing process to form a permanent image thereon. After transfer, excess toner left on the electrophotographic imaging member is cleaned from its surface, and residual charge is erased from the electrophotographic imaging member.

Electrophotographic imaging member can be provided in a number of forms. For example, the electrophotographic imaging member can be a homogeneous layer of a single material, such as vitreous selenium, or it can be a composite layer containing an electrophotographic layer and another material. In addition, the electrophotographic imaging member can be layered. Current layered electrophotographic imaging member generally have at least a flexible substrate support layer and two active layers. These active layers generally include a charge generating layer containing a light absorbing material, and a charge transport layer containing charge transport molecules. These layers can be in any order, and sometimes can be combined in a single or a mixed layer. The flexible substrate support layer can be formed of a conductive material. Alternatively, a conductive layer can be formed on top of a nonconductive flexible substrate support layer.

An electrophotographic imaging member can be in a rigid drum configuration or in a flexible belt configuration that can be either a seamless or a seamed belt. In order to ensure that the electrophotographic imaging member belts exhibit sufficient flatness, an anticurl backing layer can be coated onto the back side of the flexible substrate support layer to counteract upward curling and ensure electrophotographic imaging member flatness. Furthermore, in order to mitigate erosion of the top outermost layer of the electrophotographic imaging member during repeated cycling processes, the outermost layer can be coated with a thin protective layer, such as a silicon hard overcoat.

Conventional binders used in electrophotographic imaging members typically contain vinyl chloride. Examples of such conventional binders are disclosed in U.S. Pat. No. 5,725,985, incorporated herein by reference in its entirety, and U.S. Pat. No. 6,017,666, incorporated herein by reference in its entirety.

SUMMARY OF THE INVENTION

Applicants have discovered a need for novel electrophotographic imaging member binders that do not include halogens, particularly vinyl chloride, and that provide good dispersion properties, good electrical performance, and good print quality.

Applicants have discovered that electrophotographic imaging member binders according to the invention; provide good dispersion properties, good electrical performance, and good print quality.

Applicant's have further discovered that because electrophotographic imaging member binders according to the invention are non-halogenated, and therefore do not contain vinyl chloride; electrophotographic imaging member binders according to the invention are environmental-friendly.

Applicants have further discovered that electrophotographic imaging member binders according to the invention have improved dispersion properties with high sensitivity pigments.

In embodiments, electrophotographic imaging member binders according to the invention include a non-halogenated copolymer of vinyl acetate and vinyl acid such as crotonic acid. In embodiments, electrophotographic imaging member binders according to the invention include a non-halogenated copolymer of 90% or more of vinyl acetate and 10% or less of crotonic acid.

In embodiments, electrophotographic imaging members of the invention include a charge transport layer, a charge generating layer and optionally a blocking layer. In embodiments, the charge generating layer contains the electrophotographic imaging member binder.

In embodiments, process cartridges according to the invention include at least one of a developing unit and a cleaning unit, and an electrophotographic imaging member containing a non-halogenated copolymer of vinyl acetate and vinyl acid such as crotonic acid.

In various embodiments, the image forming apparatus contains at least one charging unit, at least one exposing unit, at least one developing unit, a transfer unit, a cleaning unit, and an electrophotographic imaging member containing a non-halogenated copolymer of vinyl acetate and vinyl acid such as crotonic acid.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
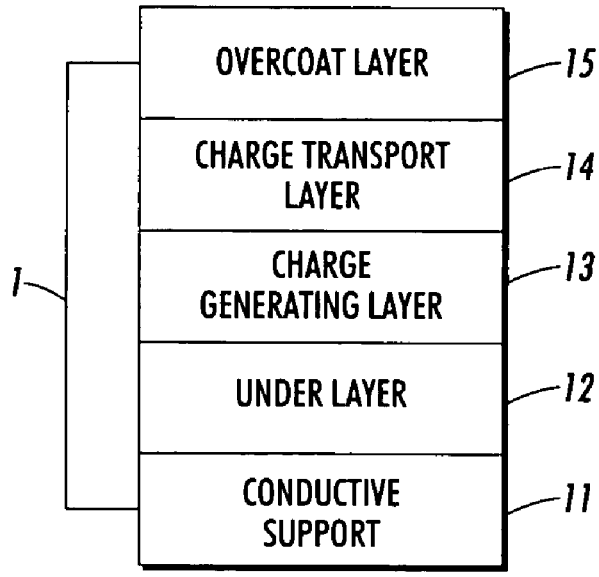
FIG. 1 is a block diagram outlining the elements of an electrophotographic imaging member.

According to the present invention, a non-halogenated polymeric binder material is provided. Preferably, the non-halogenated polymeric binder material is completely free of halogen species, or is at least substantially free of such halogen species such that any halogen species that are present do not alter the properties of the non-halogenated polymeric binder material. Thus, for example, halogen species may be present so long as they are present only in impurity or non-effective amounts. Preferably, at least the polymer chain is halogen-free, i.e., halogenated monomers are not used in producing the non-halogenated polymeric binder. Complete, substantial, and/or effective absence of halogen species from the non-halogenated polymeric binder material is preferred because of the known environmental effects that are caused by such halogenated materials. By obviating the use of halogenated species in producing the non-halogenated polymeric binder material, more environmentally friendly results are provided in the production, handling, use, and disposal of the final products incorporating the binder.

Any suitable monomer species may be used in producing the non-halogenated polymeric binder material. Thus, for example, suitable binder materials may be formed from a starting material including one or more different type of monomer species, such as but not limited to, vinyl acetate, vinyl alcohol, vinyl butyral, acrylic, vinyl ether, vinyl pyidine, hydroxyethyl acrylate, crotonic acid, maleic acid, vinyl benzoic acid, vinyl phosphonic acid and the like. Preferably, the non-halogenated polymeric binder material is formed from monomers of vinyl acetate and vinyl acid including vinyl crotonic acid, malic acid, vinyl benzoic acid or vinyl phosphonic acid. Most preferably, the non-halogenated polymeric binder material is formed from monomers of vinyl acetate and crotonic acid. When used in combinations of two or more, the monomer species may be present in any desired amount to provide a resultant non-halogenated polymeric binder material.

In embodiments, the electrophotographic imaging member binders according to the invention include a non-halogenated copolymer of 90 weight % or more of vinyl acetate, such as from about 90 to about 99.9 weight % vinyl acetate, and 10 weight % or less of vinyl acid, such as from about 0.1 to about 10 weight % crotonic acid, such that the sum of the percentages of vinyl acetate and vinyl acid is 100 weight %. Preferably, the electrophotographic imaging member binders according to the invention include a non-halogenated copolymer of 95 weight % or more of vinyl acetate, and 5 wt % or less of vinyl acid. Most preferably, the electrophotographic imaging member binders according to the invention include a non-halogenated copolymer of 99 weight % or more of vinyl acetate, and 1 wt % or less of vinyl acid.

In embodiments, non-halogenated copolymers according to the invention have the following structural formula:

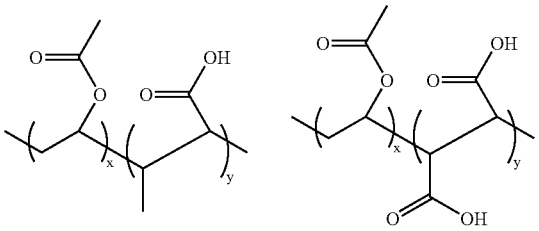

-continued

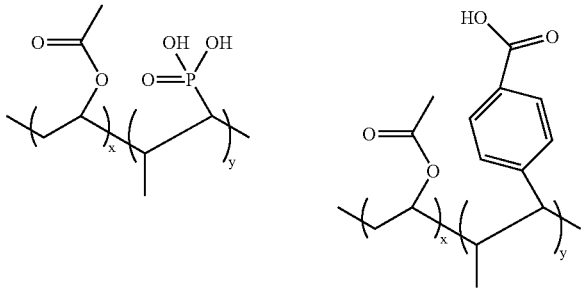

Where x and y represent weight fractions of the respective monomer species, and where preferably the weight fraction x=90-99.9% and the weight fraction y=0.1-10%, such that the sum of the mole fractions (x+y) is 100%.

In embodiments, the non-halogenated copolymer according to the invention has a weight average molecular weight of about 10,000 to about 300,000, preferably about 100,000 to about 250,000, and most preferably about 140,000 to about 200,000. In embodiments, the non-halogenated copolymer may be dissolved in a suitable solvent for use as an electrophotographic imaging member binder. Suitable solvents include organic solvents such as methanol, ethanol, n-propanol, n-butanol, benzyl alcohol, methyl cellosolve, ethyl cellosolve, acetone, methyl ethyl ketone, methyl isobutyl ketone, cyclohexanone, chlorobenzene, methyl acetate, n-butyl acetate, dioxane, tetrahydrofuran, methylene chloride and chloroform, mixtures of two or more of thereof, and the like.

In embodiments, the electrophotographic imaging member binder according to the invention may include various organic pigments and organic dyes. In embodiments, the organic pigments and organic dyes may include an azo pigment, a quinoline pigment, a perylene pigment, an indigo pigment, a thioindigo pigment, a bisbenzimidazole pigment, a phthalocyanine pigment, a quinacridone pigment, a quinoline pigment, a lake pigment, an azo lake pigment, an anthraquinone pigment, an oxazine pigment, a dioxazine pigment, a triphenylmethane pigment, an azulenium dye, a squalium dye, a pyrylium dye, a triallylmethane dye, a xanthene dye, a thiazine dye and cyanine dye; and inorganic materials such as amorphous silicon, amorphous selenium, tellurium, a selenium-tellurium alloy, cadmium sulfide, antimony sulfide, zinc oxide and zinc sulfide or combinations of two or more thereof.

Any suitable technique may be utilized to disperse the pigment particles in the charge generating layer solution dissolved in a suitable solvent. Typical dispersion techniques include, for example, ball milling, roll milling, milling in vertical or horizontal agitators, sand milling, and the like which utilize milling media. The solids content of the mixture being milled can be selected from a wide range of concentrations. In embodiments, the milling time using a ball roll mill is between about 4 and about 6 days. In embodiments, the photoconductive particles with or without binder may be milled in the absence of a solvent prior to forming the final coating dispersion. In embodiments, a concentrated mixture of photoconductive particles and binder solution may be initially milled and thereafter diluted with additional binder solution for coating mixture preparation purposes.

In embodiments, the electrophotographic imaging member binder according to the invention has a reflective scattering index (RSI) value of less than 30, of less than 20, or of less than 10. The RSI value is a measure via UV-Vis spectrometer of the dispersion of the pigment in the non-halogenated copolymer binder, and is calculated by graphing the absorbance value of the dispersion at various wavelengths. Specifically, the RSI is calculated by dividing the absorbance of the dispersion at 1000 nm by the absorbance of the dispersion at its highest absorbance peak, and multiplying the dividend by 100. The inventors have discovered that an RSI value of 30 and above results in unstable dispersion and bad print quality with the device using the dispersion. In addition, the inventors have discovered than an RSI value of less than 30, and in particular of less than 10, results in stable dispersion and excellent print quality with the device using the dispersion. The smaller the RSI value, the better the dispersion, which results in excellent electrical performance including long cyclic life, little black spots, etc.

FIG. 1 is a cross sectional view schematically showing an embodiment of an electrophotographic imaging member according to the invention. The electrophotographic imaging member 1 shown in FIG. 1 contains separately provided charge generation layer 13 and charge transport layer 14. That is to say, an undercoat layer 12, the charge generation layer 13, the charge transport layer 14 and a protective layer 15 are laminated in this order on a conductive support 11. In embodiments, the charge generation layer 13 contains the electrophotographic imaging member binder according to the invention. In embodiments, any or all layers of the electrophotographic imaging member may contain the copolymer binder according to the invention.

In embodiments, the conductive support 11 may include, for example, a metal plate, a metal drum or a metal belt using a metal such as aluminum, copper, zinc, stainless steel, chromium, nickel, molybdenum, vanadium, indium, gold or a platinum, or an alloy thereof and paper or a plastic film or belt coated, deposited or laminated with a conductive polymer, a conductive compound such as indium oxide, a metal such as aluminum, palladium or gold, or an alloy thereof. Further, surface treatment such as anodic oxidation coating, hot water oxidation, chemical treatment, coloring or diffused reflection treatment such as graining can also be applied to a surface of the support 11.

In embodiments, binding resins used in the undercoat layer 12 may include a polyamide resin, a vinyl chloride resin, a vinyl acetate resin, a phenolic resin, a polyurethane resin, a melamine resin, a benzoguanamine resin, a polyimide resin, a polyethylene resin, a polypropylene resin, a polycarbonate resin, an acrylic resin, a methacrylic resin, a vinylidene chloride resin, a polyvinyl acetal resin, a vinyl chloride-vinyl acetate copolymer, a polyvinyl alcohol resin, a water-soluble polyester resin, nitrocellulose, casein, gelatin, polyglutamic acid, starch, starch acetate, amino starch, polyacrylic acid, polyacrylamide, a zirconium chelate compound, a titanyl chelate compound, a titanyl alkoxide compound, an organic titanyl compound and a silane coupling agent. These can be used either alone or as a combination of two or more of them. Further, fine particles of titanium oxide, zinc oxide, tin oxide, antimony-doped tin oxide, aluminum oxide, silicon oxide, zirconium oxide, barium titanate, or the like may be added to the above-mentioned binding resin.

As a coating method in forming the undercoat layer, an ordinary method such as blade coating, Mayer bar coating, spray coating, dip coating, bead coating, air knife coating or curtain coating is employed. In embodiments, the thickness of the underlayer is from 0.01 to 40 μm.

After formation of an electrically conductive surface, a hole blocking layer may be applied thereto. Any suitable blocking layer capable of forming an electronic barrier to holes between the adjacent photoconductive layer and the underlying conductive layer may be utilized. In embodiments, the blocking layer may include an oxidized surface that inherently forms on the outer surface of most metal ground plane surfaces when exposed to air. The blocking layer may be applied as a coating by any suitable conventional technique. In embodiments, the blocking layer is continuous and has a thickness of less than about 2 micrometers or from about 1 to about 2 micrometers, because greater thicknesses may lead to undesirably high residual voltage. In embodiments, the blocking layer is composed of three components: zirconium tributoxides, gamma amino propyltriethoxy silane, and polyvinyl butyral. In embodiments, the proportions of these three components are as follows: 2 parts of the zirconium tributoxides to 1 part gamma amino propyltriethoxy silane by mole ratio; and 90 parts by weight of the above mixture of the zirconium tributoxides and gamma amino propyltriethoxy silane to 10 parts by weight of the polyvinyl butyral.

In embodiments, the charge generation layer 13 may include the electrophotographic imaging member binder according to the invention. The charge generation layer 13 may be formed by vacuum deposition or application of a coating solution containing the electrophotographic imaging member binder according to the invention.

In embodiments, the solvents used in preparing the charge generating layer coating solution may include organic solvents such as methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride and chloroform. These can be used either alone or as a mixture of two or more of them.

In embodiments, suitable technique to apply the charge generating layer coating to the substrate to be coated may include dip coating, roll coating, spray coating, rotary atomizers, and the like. The coating techniques may use a wide concentration of solids. In embodiments, the solids content is between about 2 percent by weight and 8 percent by weight based on the total weight of the dispersion. The expression "solids" refers to the pigment particle and binder components of the charge generating layer coating dispersion. Generally, a more concentrated coating dispersion is preferred for roll coating. Drying of the deposited coating may be effected by any suitable conventional technique such as oven drying, infra-red radiation drying, air drying and the like.

In embodiments, a stabilizer such as an antioxidant or an inactivating agent can be added to the charge generation layer 13. The antioxidants include, for example, antioxidants such as phenolic, sulfur, phosphorus and amine compounds. The inactivating agents include bis(dithiobenzyl)nickel and nickel di-n-butylthiocarbamate.

The sensitivity of an electrophotographic imaging member is affected by the thickness of the charge generating layer. A thicker charge generating layer results in a more sensitive photoreceptor. An increase in pull rate corresponds to an increase in thickness of the charge generating layer. The sensitivity (dV/dX) of an electrophotographic imaging member can be measured at various pull rates by measuring the initial slope of the photo-induced discharge curve (PIDC).

However, increasing the thickness of a charge generating layer also has the negative effect of increasing the voltage depletion of the electrophotographic imaging member. Voltage depletion is the loss of charge on the surface of the electrophotographic imaging member that results when some of the charge migrates from the surface of the electrophotographic imaging member into the charge generating layer. Voltage depletion can be measured by charging the surface of an electrophotographic imaging member, performing a photo-induced discharge of the surface, and then measuring the amount of charge that was discharged from the surface. The difference between the amount of charge applied to the surface and the amount of charge discharged from the surface is the voltage depletion amount, which indicates how much of the original charge migrated from the surface of the electrophotographic imaging member into the charge generating layer.

The inventors have discovered that a voltage depletion of 50 V and above results in high dark decay and energy consumption. In addition, the inventors have discovered that a voltage depletion of less than about 30 V, or less than about 20 V, results in excellent electrical performance. Theoretically, the smaller the voltage depletion, the better the electrical performance of the photoreceptor device. Furthermore, the inventors have discovered that a charge generating layer containing the electrophotographic imaging binder according to the invention can decrease voltage depletion independent of, and without negatively affecting, the thickness of the charge generating layer.

In embodiments, the charge transport layer 14 of FIG. 1 can be formed by applying a coating solution containing the charge transport substance and a binding resin, and further fine particles, an additive, etc. such as metal oxides, silicon oxides, PTFE microparticles. The charge transport layer may include any suitable activating compound that, as an additive dispersed in electrically inactive polymeric materials makes, these materials electrically active. These compounds may be added to polymeric materials which are incapable of supporting the injection of photogenerated holes from the charge generation material and incapable of allowing the transport of these holes therethrough. This will convert the electrically inactive polymeric material to a material capable of supporting the injection of photogenerated holes from the charge generation material and capable of allowing the transport of these holes through the active layer in order to discharge the surface charge on the active layer. In embodiments, the charge transport layer is from about 25 percent to about 75 percent by weight of at least one charge transporting aromatic amine compound, and about 75 percent to about 25 percent by weight of a polymeric film forming resin in which the aromatic amine is soluble.

In embodiments, the low molecular weight charge transport substances may include, for example, pyrene, carbazole, hydrazone, oxazole, oxadiazole, pyrazoline, arylamine, arylmethane, benzidine, thiazole, stilbene and butadiene compounds. Further, the high molecular weight charge transport substances may include, for example, poly-N-vinylcarbazole, poly-N-vinylcarbazole halide, polyvinyl pyrene, polyvinylanthracene, polyvinylacridine, a pyrene-formaldehyde resin, an ethylcarbazole-formaldehyde resin, a triphenylmethane polymer and polysilane.

In embodiments, the binding resin is a high molecular weight polymer which can form an electrical insulating film. For example, when the polyvinyl acetal resin, the polyamide resin, the cellulose resin, the phenol resin, etc., which are the resins soluble in the alcoholic solvents, are used, the binding resins used together with these resins include a polycarbonate, a polyester, a methacrylic resin, an acrylic resin, polyvinyl chloride, polyvinylidene chloride, polystyrene, polyvinyl acetate, a styrene-butadiene copolymer, a vinylidene chloride-acrylonitrile copolymer, a vinyl chloride-vinyl acetate copolymer, vinyl chloride-vinyl acetate-maleic anhydride copolymer, a silicone resin, a silicone-alkyd resin, a phenol-formaldehyde resin, a styrene-alkyd resin, poly-N-vinylcarbazole, polyvinyl butyral, polyvinyl formal, a polysulfone, casein, gelatin, polyvinyl alcohol, a phenol resin, a polyamide, carboxymethyl cellulose, a vinylidene chloride-based polymer latex and a polyurethane.

In embodiments, the charge transport layer 14 may contain an additive such as a plasticizer, a surface modifier, an antioxidant or an agent for preventing deterioration by light.

Any suitable and conventional technique may be utilized to mix and thereafter apply the charge transport layer coating mixture to the coated or uncoated substrate. Typical application techniques include spraying, dip coating, roll coating, wire wound rod coating, and the like. Drying of the deposited coating may be effected by any suitable conventional technique such as oven drying, infra-red radiation drying, air drying and the like.

The protective layer 15 of FIG. 1 may contain a resin, a silicon compound and metal oxide nanoparticles. The protective layer 15 may further contain a lubricant or fine particles of a silicone oil or a fluorine material, which can also improve lubricity and strength. In embodiments, the thickness of the protective layer is from 0.1 to 10 μm, from 0.5 to 7 μm, or from 1.5 to 3.5 μm.

In embodiments, an overcoat layer may be utilized to improve resistance to abrasion. In some cases an anti-curl back coating may be applied to the side opposite the electrophotographic imaging member to provide flatness and/or abrasion resistance where a web configuration photoreceptor is fabricated. Overcoatings are continuous and generally have a thickness of less than about 10 micrometers. The thickness of anti-curl backing layers should be sufficient to substantially balance the total forces of the layer or layers on the opposite side of the supporting substrate layer. An example of an anti-curl backing layer is described in U.S. Pat. No. 4,654,284 the entire disclosure of this patent being incorporated herein by reference. A thickness between about 70 and about 160 micrometers is a satisfactory range for flexible photoreceptors.

In embodiments, a non-contact charging system (e.g., a corotron charger) or a contact charging device, an exposure device, a developing device, a transfer device and a cleaning unit are arranged along the rotational direction of an electrophotographic imaging member according to the invention. In embodiments, this apparatus is equipped with an image fixing device, and a medium to which a toner image is to be transferred is conveyed to the image fixing device through the transfer device.

In embodiments, the contact charging device has a roller-shaped contact charging member. The contact charging member is arranged so that it comes into contact with a surface of the electrophotographic imaging member, and a voltage is applied, thereby being able to give a specified potential to the surface of the electrophotographic imaging member. As a material for such a contact charging member, there can be used a metal such as aluminum, iron or copper, a conductive polymer material such as a polyacetylene, a polypyrrole or a polythiophene, or a dispersion of fine particles of carbon black, copper iodide, silver iodide, zinc sulfide, silicon carbide, a metal oxide or the like in an elastomer material such as polyurethane rubber, silicone rubber, epichlorohydrin rubber, ethylene-propylene rubber, acrylic rubber, fluororubber, styrene-butadiene rubber or butadiene rubber. Examples of the metal oxides include ZnO, $SnO_2$, $TiO_2$, $In_2O_3$, $MoO_3$ and a complex oxide thereof. Further, a perchlorate may be added to the elastomer material to impart conductivity.

In embodiments, a covering layer can also be provided on a surface of the contact charging member. Materials for forming this covering layer may include N-alkoxymethylated nylon, a cellulose resin, a vinylpyridine resin, a phenol resin, a polyurethane, polyvinyl butyral and melamine, and these may be used either alone or as a combination of two or more of them. Furthermore, an emulsion resin material such as an acrylic resin emulsion, a polyester resin emulsion or a polyurethane, particularly an emulsion resin synthesized by soap-free emulsion polymerization can also be used. In order to further adjust resistivity, conductive agent particles may be dispersed in these resins, and in order to prevent deterioration, an antioxidant can also be added thereto. Further, in order to improve film forming properties in forming the covering layer, a leveling agent or a surfactant can also be added to the emulsion resin.

In embodiments, the resistance of the contact charging member is from $10^0$ to $10^{14}$ Ωcm, or from $10^2$ to $10^{12}$ Ωcm. When a voltage is applied to this contact charging member, either a DC voltage or an AC voltage can be used as the applied voltage. Further, a superimposed voltage of a DC voltage and an AC voltage can also be used. Such a contact charging member may be in the shape of a blade, a belt, a brush or the like.

In embodiments, the exposure device can be an optical device which can perform desired imagewise exposure to a surface of the electrophotographic imaging member with a light source such as a semiconductor laser, an LED (light emitting diode) or a liquid crystal shutter. In various embodiments, the use of the exposure device makes it possible to perform exposure to noninterference light.

In embodiments, the developing device can be a known or later used developing device using a normal or reversal developing agent of a one-component system, a two-component system or the like. There is no particular limitation on the shape of a toner used, and for example, an irregularly shaped toner obtained by pulverization or a spherical toner obtained chemical polymerization is suitably used.

In embodiments, the transfer device can be a contact type transfer charging device using a belt, a roller, a film, a rubber blade or the like, or a scorotron transfer charger or a corotron transfer charger utilizing corona discharge.

In embodiments, the cleaning device can be a device for removing a remaining toner adhered to the surface of the electrophotographic photoreceptor after a transfer step, and the electrophotographic photoreceptor cleaned up thereby is repeatedly subjected to the above-mentioned image formation process. The cleaning device can be a cleaning blade, a cleaning brush, a cleaning roll or the like. In embodiments, a cleaning blade is used. Materials for the cleaning blade may include urethane rubber, neoprene rubber and silicone rubber.

In various embodiments, the respective steps of charging, exposure, development, transfer and cleaning are conducted in turn in the rotation step of the electrophotographic imaging member, thereby repeatedly performing image formation. In embodiments, the electrophotographic imaging member is provided with a silicon hard overcoat. Accordingly, even when the photoreceptor is used together with the contact charging device or the cleaning blade, or further with the spherical toner obtained by chemical polymerization, good image quality can be obtained with a good wear rate and no adverse effects on electric properties of the photoreceptor.

In embodiments, an intermediate transfer belt is supported with a driving roll, a backup roll and a tension roll at a specified tension, and rotatable by the rotation of these rolls without the occurrence of deflection. Further, a secondary transfer roll can be arranged so that it is brought into abutting contact with the backup roll through the intermediate transfer belt. The intermediate transfer belt which has passed between the backup roll and the secondary transfer roll can be cleaned up by a cleaning blade, and then repeatedly subjected to the subsequent image formation process.

The invention should not be construed as being limited to the above-mentioned embodiments. For example, in embodiments, the image forming apparatus can be equipped with a process cartridge comprising the electrophotographic imaging member(s) and charging device(s). The use of such a process cartridge allows maintenance to be performed more simply and easily.

Furthermore, in embodiments, a toner image formed on the surface of the electrophotographic imaging member can be directly transferred to the medium to which the toner image is to be transferred. However, in various embodiments, the image forming apparatus of the invention may be further provided with an intermediate transfer body. This makes it possible to transfer the toner image from the intermediate transfer body to the medium to which the toner image is to be transferred, after the toner image on the surface of the electrophotographic imaging member has been transferred to the intermediate transfer body. In embodiments, the intermediate transfer body can have a structure in which an elastic layer containing a rubber, an elastomer, a resin or the like and at least one covering layer are laminated on a conductive support.

In addition, in embodiments, the image forming apparatus of the invention may be further equipped with a static eliminator such as an erase light irradiation device. This prevents the phenomenon of incorporating the residual potential of the electrophotographic imaging member into the subsequent cycle, when the electrophotographic imaging member is repeatedly used. Accordingly, image quality can be more improved.

Examples are set forth hereinbelow and are illustrative of embodiments of the present invention. It will be apparent, however, that the invention can be practiced with many types of compositions and can have many different uses in accordance with the disclosure above and as pointed out hereinafter.

EXAMPLE

An embodiment of an electrophotographic imaging member binder according to the invention was prepared according to the following formula outlined in Table 1:

TABLE 1

| Component | Amount |
|---|---|
| copolymer of vinyl acetate and crotonic acid | 2 parts |
| *vinyl acetate | 1.98 parts |
| *crotonic acid | 0.02 parts |
| hydroxygallium phathalocyanine | 3 parts |
| n-butyl acetate | 95 parts |

Specifically, the dispersion was prepared by Attritor milling the pigment (HOGaPc) and copolymer at a ratio of 60/40 in n-butyl acetate for 10 hours. The copolymer is VINNAPAS C501 from Wacker Chemical, which has a M.W. of 140,000-200,000 and acid number of 6-9 mg KOH/g. The 200 g dispersion was milled with 600 g of 1.0-1.25 mm Glen Mills glass beads.

In addition, an electrophotographic imaging member according to the invention, was prepared. Specifically, the binder was diluted with n-butyl acetate to a solid content of about 5.0 weight percent and coated in a charge generating layer (CGL) onto a photoreceptor.

The RSI value of the dispersion, the photosensitivity of the photoreceptor, and the voltage depletion of the photoreceptor were evaluated. The results are presented in FIGS. 2-4, respectively.

Figure 2:
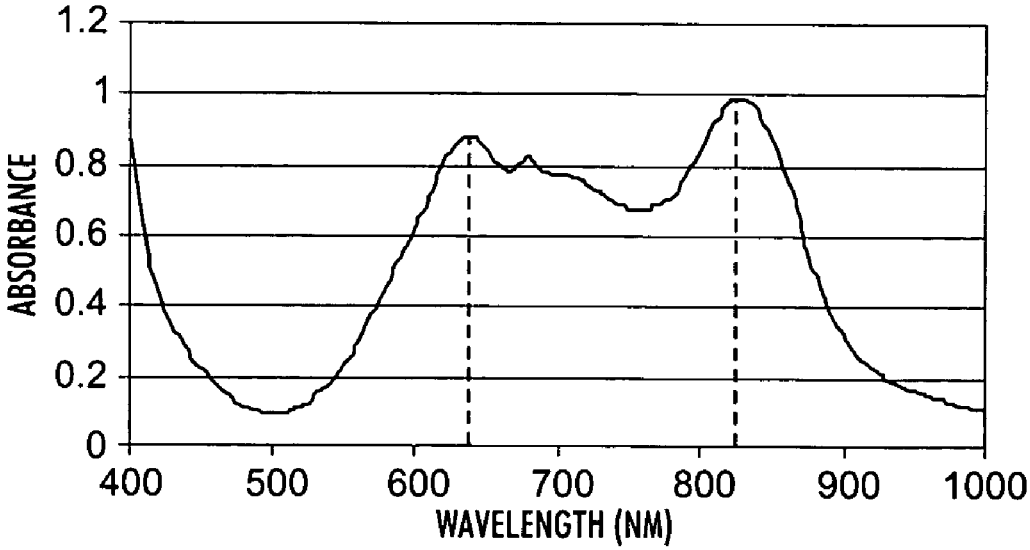
FIG. 2 is a graph illustrating the absorbance values at various wavelengths for an embodiment of hydroxygallium-phathalocyanine (HOGaPc) dispersed in an electrophotographic imaging member binder according to the invention.

As can be seen in FIG. 2, the UV-Vis absorbance value at 1000 nm is approximately 0.1, and the absorbance at the maximum peak is approximately 1. Thus, the binder has an RSI value of approximately 10. Accordingly, the RSI of dispersions containing the non-halogen copolymer of vinyl acetate and crotonic acid has an RSI value well below 30.

Figure 3:
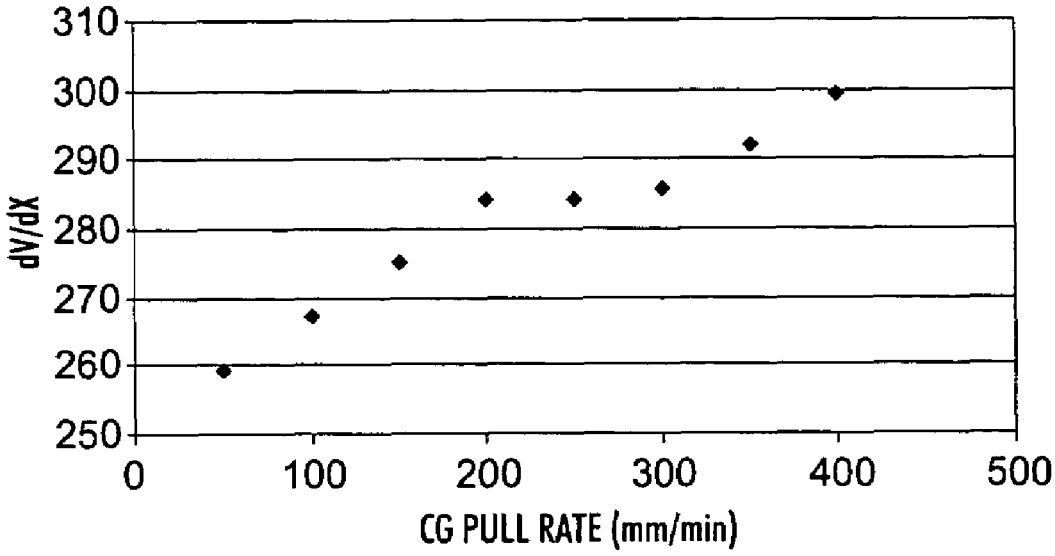
FIG. 3 is a graph illustrating the photosensitivity of an electrophotographic imaging member according to the invention.

As can be seen in FIG. 3, the photosensitivity of the photoreceptor (i.e.,dV/dX) increases with an increase in the thickness of the charge generating layer (i.e., CG Pull Rate). Accordingly, the increase in sensitivity corresponding to an increase in CGL thickness of photoreceptors coated with charge generating layers that contain the non-halogen copolymer of vinyl acetate and crotonic acid is not adversely affected. From the photo-induced discharge curve (PIDC), the photosensitivity can be readily obtained by calculating the initial slope of the curve.

Figure 4:
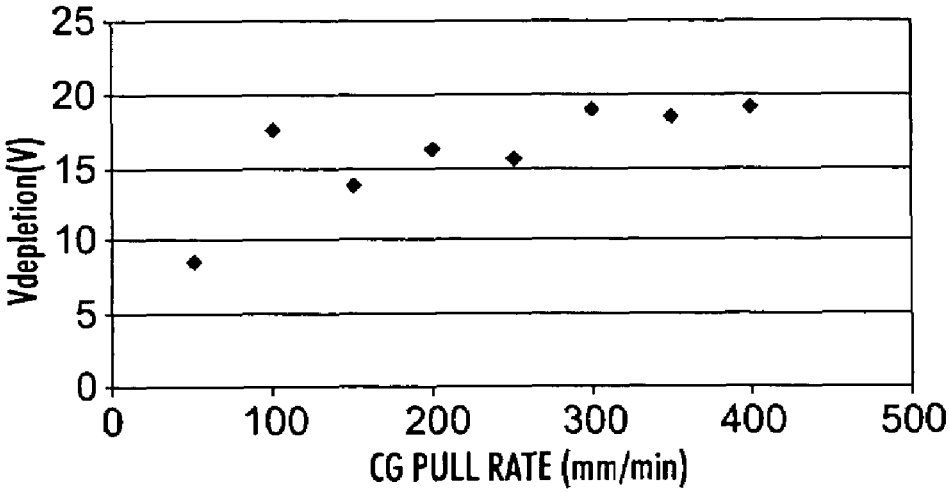
FIG. 4 is a graph illustrating the voltage depletion values for an embodiment of an electrophotographic imaging member according to the invention.

As can be seen in FIG. 4, the voltage depletion of the photoreceptor remains below 20 V, and thus is well below a voltage depletion of 50 V. Furthermore, the voltage depletion of the photoreceptor that is not affected by an increase in the thickness of the charge generating layer (i.e., CG Pull Rate). Accordingly, photoreceptors coated with charge generating layers that contain the non-halogen copolymer of vinyl acetate and crotonic acid have the benefit of a low voltage depletion that is independent of CGL thickness.

While this invention has been described in conjunction with the embodiments set forth above, it is evident that many alternatives, modifications and variations will be apparent to those skilled in the art. Accordingly, the embodiments of the invention set forth above are intended to be illustrative and not limiting. Various changes may be made without departing from the spirit and the scope of the invention as defined in the following claims.

What is claimed is:

1. An electrophotographic imaging member binder, comprising a non-halogenated terpolymer of vinyl acetate, vinyl acid, and vinyl alcohol.

2. The electrophotographic imaging member binder of claim 1, comprising a terpolymer of 90% or more of vinyl acetate, 10% or less of vinyl acid, and 0.2% of vinyl alcohol, wherein the sum of the percentages of vinyl acetate, vinyl acid, and vinyl alcohol is 100%.

3. The electrophotographic imaging member binder of claim 1, wherein said vinyl acid is at least one member selected from the group consisting of crotonic acid, maleic acid, vinyl benzoic acid and vinyl phosphonic acid.

4. The electrophotographic imaging member binder of claim 1, wherein the non-halogenated terpolymer has a weight average molecular weight of about 10,000 to about 300,000.

5. An electrophotographic imaging member comprising the electrophotographic imaging member binder of claim 1.

6. The electrophotographic imaging member of claim 5, comprising a charge-generating layer, a charge transport layer, and optionally a blocking layer.

7. The electrophotographic imaging member of claim 5, wherein said charge-generating layer contains said electrophotographic imaging member binder.

8. A process cartridge comprising at least one of a developing unit and a cleaning unit, and the electrophotographic imaging member of claim 5.

9. An image forming apparatus comprising at least one charging unit, at least one exposing unit, at least one developing unit, a transfer unit, a cleaning unit, and the electrophotographic imaging member of claim 5.

10. The image forming apparatus of claim 9, wherein the transfer unit is an intermediate transfer body for temporarily transferring the toner image formed on the electrophotographic imaging member.

11. The image forming apparatus of claim 10, comprising a plurality of electrophotographic imaging members arranged along the intermediate transfer body.

* * * * *